US007057578B2

(12) United States Patent
Yaniv

(10) Patent No.: US 7,057,578 B2
(45) Date of Patent: Jun. 6, 2006

(54) ACTIVE PROJECTION SCREEN

(75) Inventor: Zvi Yaniv, Austin, TX (US)

(73) Assignee: SI Diamond Technology, Inc., Austin, TX (US)

( * ) Notice: Subject to any disclaimer, the term of this patent is extended or adjusted under 35 U.S.C. 154(b) by 522 days.

(21) Appl. No.: 10/164,729

(22) Filed: Jun. 6, 2002

(65) Prior Publication Data

US 2002/0196198 A1 Dec. 26, 2002

Related U.S. Application Data

(60) Provisional application No. 60/296,829, filed on Jun. 8, 2001.

(51) Int. Cl.
*G09G 5/00* (2006.01)

(52) U.S. Cl. ..... 345/1.1; 345/1.2; 345/1.3; 345/2.2; 345/3.1; 353/22; 353/23; 353/28; 353/29; 359/443

(58) Field of Classification Search ..... 345/1.1–1.3, 345/2.2, 3.1; 353/22–23, 28, 29; 359/443
See application file for complete search history.

(56) References Cited

U.S. PATENT DOCUMENTS

| | | | | |
|---|---|---|---|---|
| 3,622,230 | A * | 11/1971 | Dimmick | 353/122 |
| 5,115,230 | A * | 5/1992 | Smoot | 345/9 |
| 6,260,973 | B1 * | 7/2001 | Minato et al. | 353/42 |
| 6,466,369 | B1 * | 10/2002 | Maddock | 359/460 |
| 6,572,232 | B1 | 6/2003 | Yaniv | 353/98 |
| 6,577,355 | B1 | 6/2003 | Yaniv | 349/16 |
| 6,588,909 | B1 | 7/2003 | Yaniv et al. | 353/98 |
| 6,616,284 | B1 | 9/2003 | Yaniv et al. | 353/79 |
| 6,726,335 | B1 | 4/2004 | Yaniv et al. | 353/98 |

* cited by examiner

*Primary Examiner*—Kent Chang
*Assistant Examiner*—Alexander S. Beck
(74) *Attorney, Agent, or Firm*—Kelly K. Kordzik; Winstead Sechrest & Minick P.C.

(57) ABSTRACT

A screen (which may be a display or electronic display) for projection that has embedded in the screen other active display technologies, such as LEDs, LCDs, etc., or the screen itself is a hybrid of translucent surfaces with a low-resolution display. This display will have two faces such that the alphanumeric information appears from left to right on both sides of the projected image.

16 Claims, 5 Drawing Sheets

ACTIVE PROJECTION SCREEN

CROSS-REFERENCES

This application claims priority to U.S. Provisional Patent Application Ser. No. 60/296,829 filed Jun. 8, 2001.

BACKGROUND INFORMATION

Today, projection displays are used more and more to display information on flat panel display screens. Numerous times, for a number of reasons, these screens need also to display simultaneous and synchronized information with the image displayed. For example, if the screen is used for advertising, but the image is produced in advance, simultaneously displaying pricing information that could change from time to time with the specific image would be very helpful and advantageous.

Furthermore, if alphanumeric data is embedded in the projected image, and only one translucent screen is used for viewing from both sides, then although the image can be seen from both sides, the alphanumeric data will be viewed as a mirror image on the opposite side.

SUMMARY OF THE INVENTION

The present invention uses a screen (which may be a display or electronic display) for projection that has embedded in the screen other active display technologies, such as LEDs, LCDs, etc., or the screen itself is a hybrid of translucent surfaces with a low-resolution display. This display will have two faces such that the alphanumeric information appears from left to right on both sides of the projected image.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
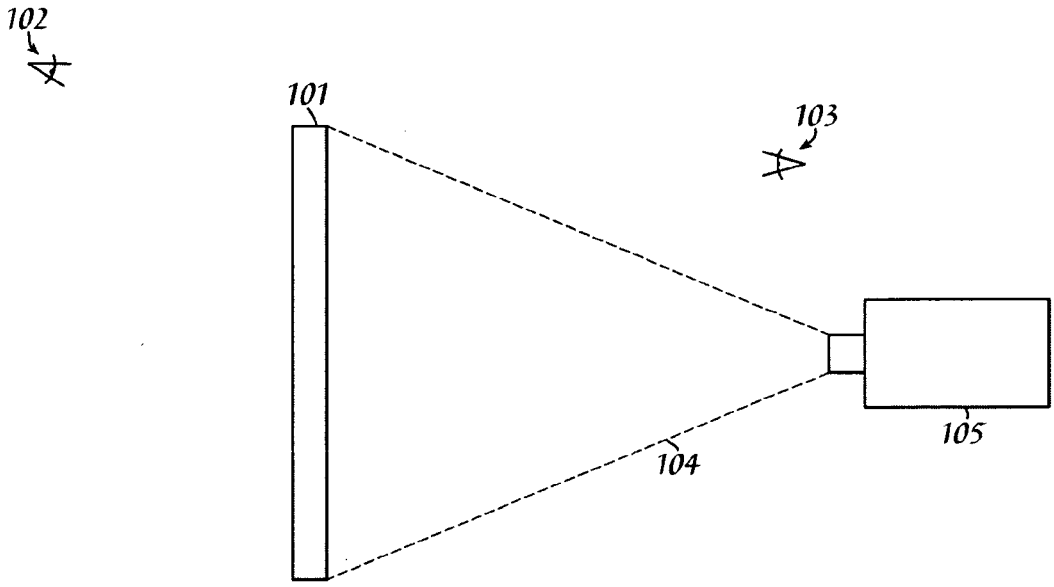
FIG. 1 illustrates a projection system whereby an image is displayed on a translucent screen for viewing from both sides of the screen.

In the following description, numerous specific details are set forth such as specific display technologies to provide a thorough understanding of the present invention. However, the present invention may be practiced without such specific details. In other instances, well-known circuits have been shown in block diagram form in order not to obscure the present invention in unnecessary detail. For the most part, details concerning timing considerations and the like have been omitted in as much as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

Figure 2:
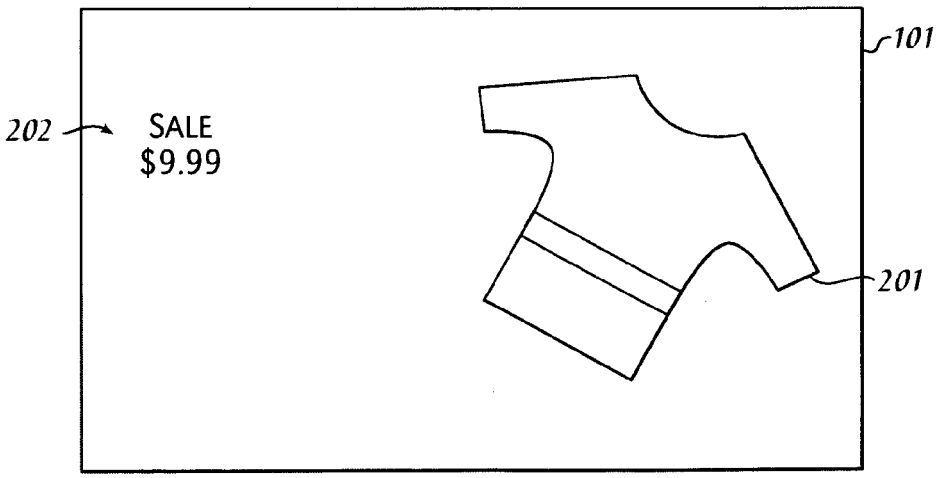
FIG. 2 illustrates an exemplary image projected by the display system in FIG. 1 on one side of the translucent display screen.
Figure 3:
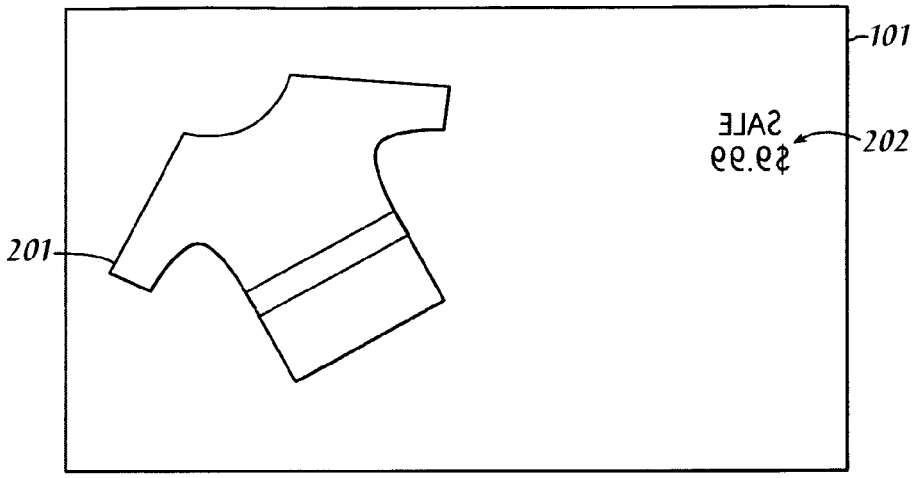
FIG. 3 illustrates the exemplary image shown in FIG. 2 as viewed from the opposite side of the display screen.

Referring to FIG. 1, there is illustrated a projection system as disclosed within U.S. patent application Ser. No. 09/519,537, which is hereby incorporated by reference, whereby an image projector 105 projects an image 104 onto a translucent screen 101, which can then be viewed by persons 102 and 103 from both sides of the display screen 101. Screen 101 may employ a mechanism that switches it to a substantially opaque (translucent) state when an image 104 is projected. FIG. 2 illustrates how image 104 might be viewed by person 102 showing an image of a shirt 201 and the price for that shirt 202 displayed in alphanumeric symbols. However, the same image 104 as seen by viewer 103 is illustrated in FIG. 3 where the image of the shirt 201 and the price information in alphanumeric symbols 202 are seen as mirror images. Clearly the problem is not with the image of the shirt 201, but with the alphanumeric price information 202, which is viewed by viewer 103 in reverse. The present invention utilizes an embedded active display technology into the screen 101 to overcome this problem.

Figure 4:
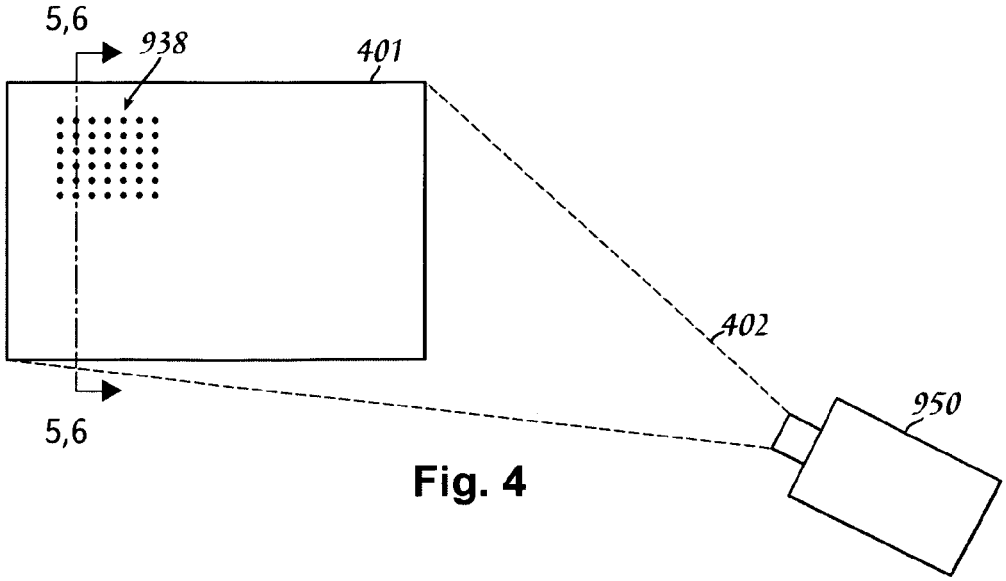
FIG. 4 illustrates a configuration of the present invention.

FIG. 4 illustrates an embodiment of the present invention whereby projector 950 projects an image 402 onto display screen 401 in a manner as similarly described above with respect to FIG. 1. The image 402 will not include alphanumeric information, since such information would be viewed in reverse by a viewer on one side of the display screen 401. This problem is solved by embedding another display technology into the screen 401 to actively display such alphanumeric information, or any other information that changes from time to time with respect to an image 402 simultaneously displayed on screen 401. In the embodiment illustrated in FIG. 4, light emitting diodes ("LEDs") 938 are embedded in a matrix within screen 401. In this example, the LEDs are three millimeter diagonal multi-color LEDs and spaced apart at a pitch of one inch. However, other sized LEDs and other pitches may be utilized within the scope of the present invention. The number of LEDs is also a variable. Alternatively, screen 401 may be a display sign, such as a billboard depicting an image, which then has another display technology embedded therein which is dynamic. Moreover, screen 401 may be an electronic display of any display technology, which has another display technology embedded therein for actively displaying an image on each side of the screen.

Figure 5:
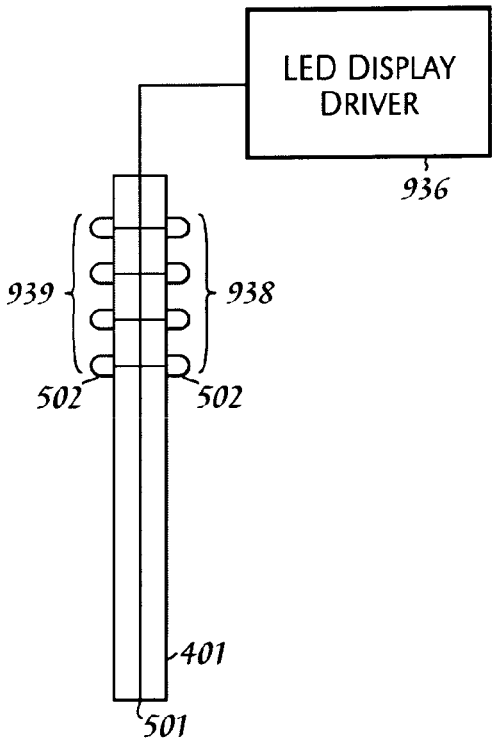
FIG. 5 illustrates one alternative embodiment of the present invention.

FIG. 5 illustrates one alternative embodiment of the present invention as seen as a cross-section of display screen 401. LEDs 938 as viewed from one side of display screen 401 are paired with oppositely embedded LEDs 939 on the other side of display screen 401. Thus each LED 502 is paired with an LED 502 on the other side of the display screen 401, and all of the LEDs are installed on a transparent printed circuit board 501 so they can be illuminated by LED display driver 936. The transparent printed circuit board thus does not interfere with the projected image 402.

Figure 6:
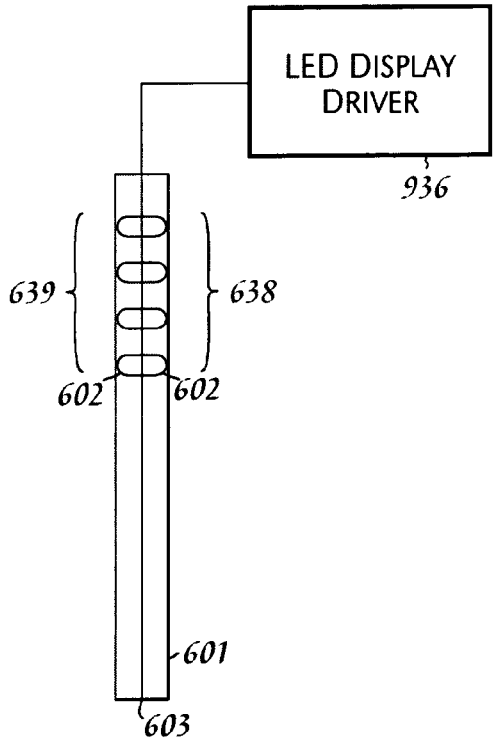
FIG. 6 illustrates another alternative embodiment of the present invention.

Another alternative embodiment of the present invention is illustrated in FIG. 6 whereby the LEDs 638 and 639 correspond to LEDs 938 and 939, but are embedded within the screen 601 and coupled to transparent printed circuit board 603 to be driven by LEDs display driver 936. What is important is an image displayed by LEDs 638, 938 is viewed only by a viewer on that side of the display screen 401, while LEDs 639, 939 display the same information to a viewer on the opposite side of the display screen. Thus the LEDs will be installed in both directions such that the alphanumeric symbols on both sides of the projector screen will not be reversed. These LEDs may be multi-color and have sufficient brightness for indoor applications. As noted above, the two surfaces of LEDs will operate electronically independently and they may be synchronized to the image 402 projected by projector 950. Other equivalent display technologies may also be used.

Figure 7:
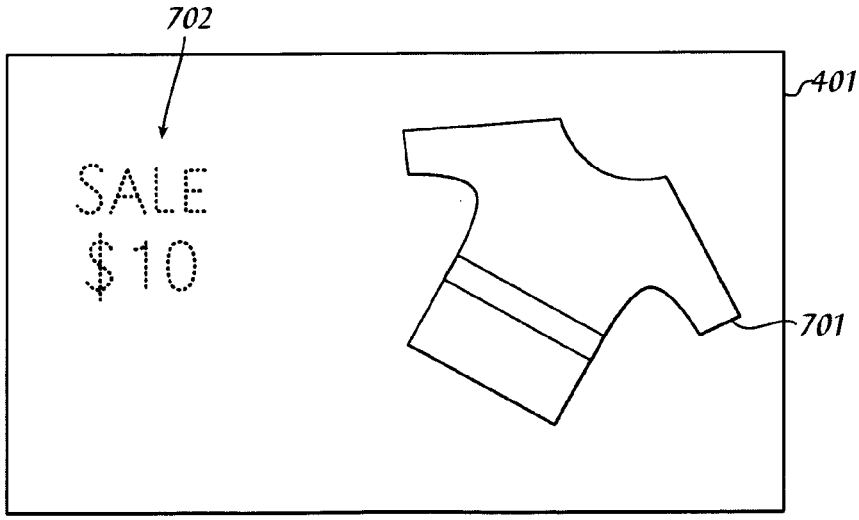
FIG. 7 illustrates an exemplary image as displayed by the present invention.
Figure 8:
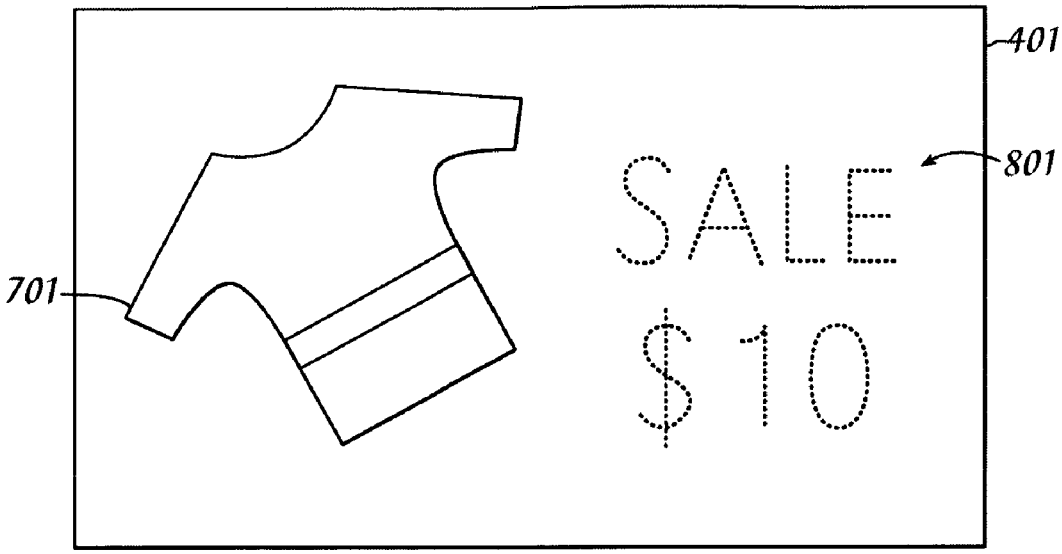
FIG. 8 illustrates the exemplary image of FIG. 7 as viewed from the opposite side of the display screen of the present invention.

FIG. 7 illustrates a projected image of a shirt 701 onto display screen 401 with synchronously displayed alphanumeric price information 702 using LEDs 938. FIG. 8 illustrates the same projected image 402 viewed from the opposite side of screen 401 showing the shirt 701 in reverse, while LEDs 938, 939 display the same pricing information 701 as pricing information 702, but not in reverse. Thus, not only is the pricing information displayed so that it can be read from both sides of the display screen 401, but it also can be edited independently from the projected image 402. For example, the price for the shirt can be changed on a periodic basis, without having to modify the projected image 402.

Figure 10:
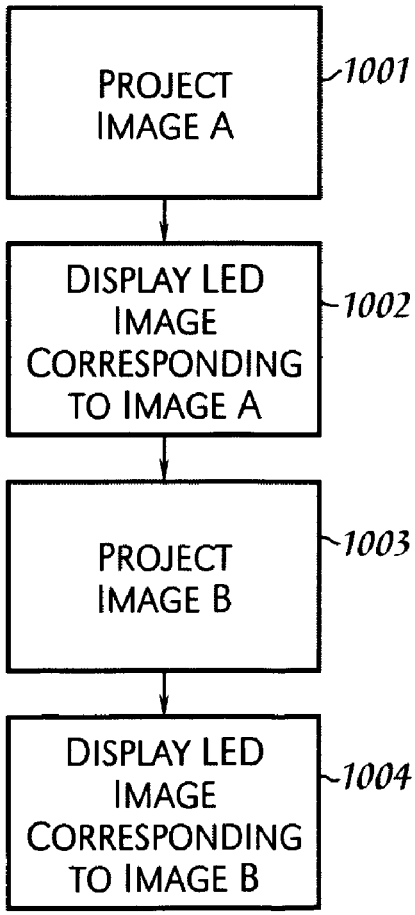
FIG. 10 illustrates a flow diagram of a method in accordance with the present invention.

FIG. 10 illustrates a flow diagram of a method in accordance with the present invention whereby in step 1001, an image A is projected by projector 950, and in step 1002, an LED image is displayed on LEDs 938 and 939 corresponding to image A. Then in step 1003, a different image B is projected by projector 950, which results in step 1004 of a different LED image displayed using LEDs 938 and 939, which corresponds to the image B.

Figure 9:
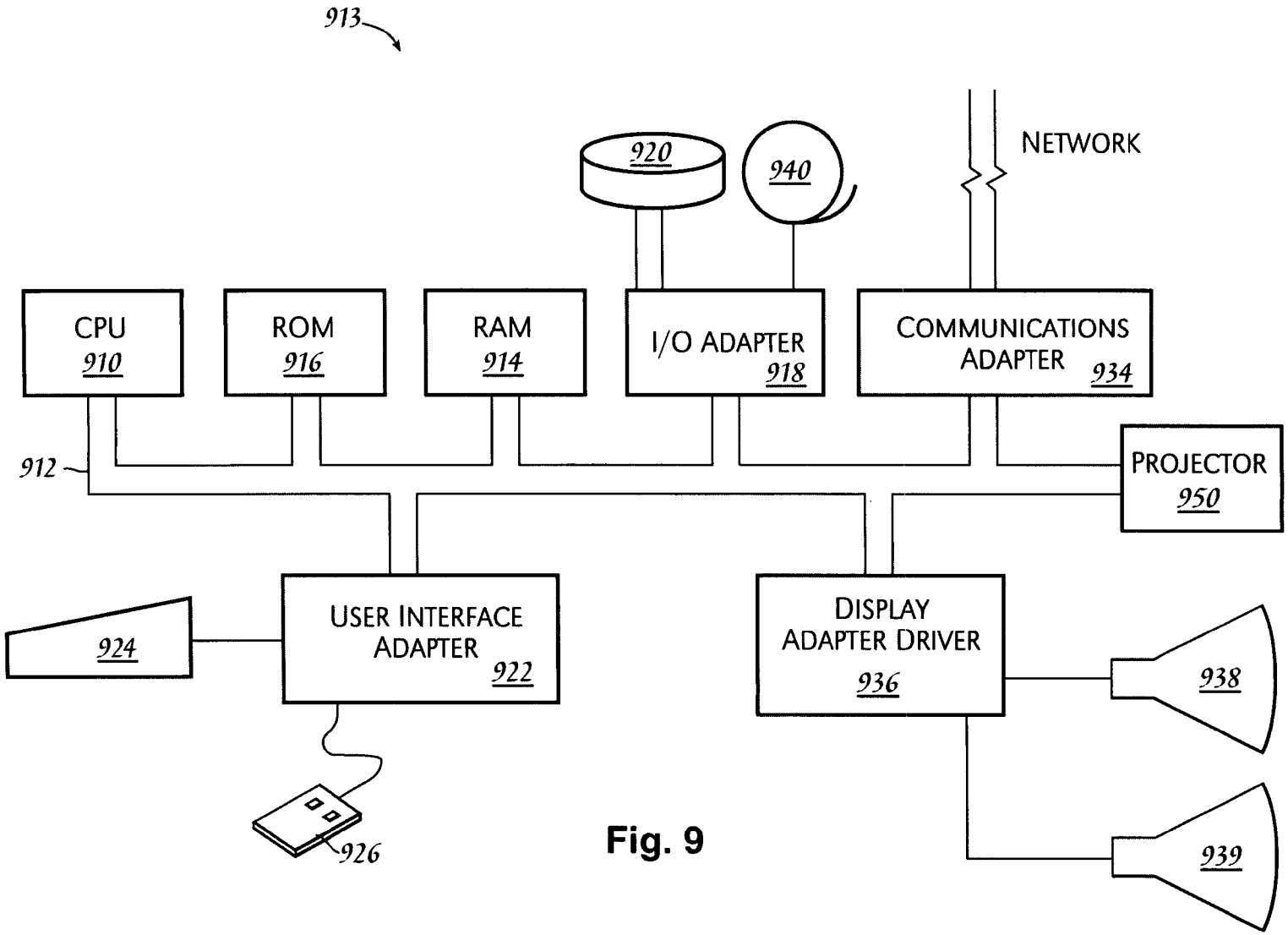
FIG. 9 illustrates an information handling system configured in accordance with the present invention.

Referring to FIG. 9, an example is shown of a data processing system 913 which may be used for the invention. The system has a central processing unit (CPU) 910, which is coupled to various other components by system bus 912. Read only memory ("ROM") 916 is coupled to the system bus 912 and includes a basic input/output system ("BIOS") that controls certain basic functions of the data processing system 913. Random access memory ("RAM") 914, I/O adapter 918, and communications adapter 934 are also coupled to the system bus 912. I/O adapter 918 may be a small computer system interface ("SCSI") adapter that communicates with a disk storage device 920. Communications adapter 934 interconnects bus 912 with an outside network enabling the data processing system to communicate with other such systems. Input/output devices are also connected to system bus 912 via user interface adapter 922 and display adapter/driver 936. Keyboard 924 and mouse 926 are interconnected to bus 912 via user interface adapter 922. Displays 938 and 939 are connected to system bus 912 by display adapter/driver 936. In this manner, a user is capable of inputting to the system throughout the keyboard 924 or mouse 926 and receiving output from the system via displays 938 and 939.

Implementations of the invention include implementations as a computer system programmed to execute the method or methods described herein, and as a computer program product. According to the computer system implementation, sets of instructions for executing the method or methods (see FIG. 10) may be resident in the random access memory 914 of one or more computer systems configured generally as described above. Until required by the computer system, the set of instructions may be stored as a computer program product in another computer memory, for example, in disk drive 920 (which may include a removable memory such as an optical disk or floppy disk for eventual use in the disk drive 920). System 913 may operate to display images using projector 950 and displays 938, 939, such as described with respect to FIGS. 1–8 and 10.

Further, the computer program product can also be stored at another computer and transmitted when desired to the user's work station by a network or by an external network such as the Internet. One skilled in the art would appreciate that the physical storage of the sets of instructions physically changes the medium upon which it is stored so that the medium carries computer readable information. The change may be electrical, magnetic, chemical, biological, or some other physical change. While it is convenient to describe the invention in terms of instructions, symbols, characters, or the like, the reader should remember that all of these and similar terms should be associated with the appropriate physical elements.

Note that the invention may describe terms such as comparing, validating, selecting, identifying, or other terms that could be associated with a human operator. However, for at least a number of the operations described herein which form part of at least one of the embodiments, no action by a human operator is desirable. The operations described are, in large part, machine operations processing electrical signals to generate other electrical signals.

What is claimed is:

1. An image display system comprising:

a projector for projecting a first image; and a screen having a first area for receiving and reflecting the first image projected from the projector, and a second area for actively displaying a second image, wherein the screen has first and second parallel sides facing opposite of each other, wherein the first area for receiving the first image projected from the projector reflects the first image on both of the first and second parallel sides, wherein the second area for actively displaying the second image is located on the screen so that the second image is viewable from the first side and not from the second side, wherein the second side includes a third area for actively displaying a third image.

2. The image display system as recited in claim 1, wherein the third image is viewable from the second side and not the first side.

3. The image display system as recited in claim 2, wherein the third image is a copy of the second image.

4. The image display system as recited in claim 3, wherein the second image is linked to the first image so that the first, second, and third images are synchronously displayed.

5. The image display system as recited in claim 1, wherein the first, second, and third areas of the screen are integral with each other.

6. The image display system as recited in claim 5, wherein the third area includes an LED display for actively displaying the third image.

7. The image display system as recited in claim 5, wherein the third area includes a CRT display for actively displaying the third image.

8. The image display system as recited in claim 5, wherein the third area includes an LCD for actively displaying the third image.

9. The image display system as recited in claim 5, wherein the third area includes a plasma display for actively displaying the third image.

10. A display screen comprising:

a first area for passively displaying a first image; and a second area for actively displaying a second image, wherein the first and second areas of the screen are integral with each other, wherein the screen has first and second parallel sides facing opposite of each other, wherein the first area for receiving the first image projected from the projector reflects the first image on both of the first and second parallel sides, wherein the first image is viewable from both of the first and second parallel sides, wherein the image viewable from the second side is a mirror image of the image viewable from the first side, wherein the second area for actively displaying the second image is located on the screen so that the second image is viewable from the first side and not from the second side, wherein the second side includes a third area for actively displaying a third image, wherein the third image is viewable from the second side and not the first side, wherein the third image is a copy of the second image.

11. The display screen as recited in claim 10, wherein the first, second, and third areas of the screen are integral with each other.

12. A method for displaying images comprising the steps of:

projecting a first image onto a screen;

actively displaying a second image on the screen, wherein the screen has first and second sides facing opposite of each other, wherein the first image is projected onto the screen so that the first image is viewable on both of the first and second sides, wherein the image viewable from the second side is a mirror image of the image viewable from the first side, wherein the second image is actively displayed on the screen so that the second image is viewable from the first side and not from the second side; and displaying a third image on the second side of the screen.

13. The method as recited in claim 12, wherein the third image is viewable from the second side and not the first side.

14. The method as recited in claim 13, wherein the third image is a copy of the second image.

15. A system for displaying images comprising:

means for projecting a first image onto a screen;

means for actively displaying a second image on the screen simultaneously with the first image, wherein the screen has first and second sides facing opposite of each other, wherein the first image is projected onto the screen so that the first image is viewable on both of the first and second sides, wherein the image viewable from the second side is a mirror image of the image viewable from the first side, wherein the second image is actively displayed on the screen so that the second image is viewable from the first side and not from the second side; and means for displaying a third image on the second side of the screen, wherein the third image is viewable from the second side and not the first side.

16. The system as recited in claim 15, wherein the third image is a copy of the second image.

* * * * *